US011398140B2

(12) United States Patent
Baldig

(10) Patent No.: US 11,398,140 B2
(45) Date of Patent: Jul. 26, 2022

(54) PRESENTATION DEVICE FOR PRESENTING A TICKET FROM A PRINTER

(71) Applicant: GeBE Elektronik und Feinwerktechnik GmbH, Germering (DE)

(72) Inventor: Klaus Baldig, Germering (DE)

(73) Assignee: GeBE Elektronik und Feinwerktechnik GmbH, Germering (DE)

( * ) Notice: Subject to any disclaimer, the term of this patent is extended or adjusted under 35 U.S.C. 154(b) by 761 days.

(21) Appl. No.: 16/375,743

(22) Filed: Apr. 4, 2019

(65) Prior Publication Data

US 2019/0308837 A1 Oct. 10, 2019

(30) Foreign Application Priority Data

Apr. 4, 2018 (EP) ..... 18165625

(51) Int. Cl.
*G07F 17/42* (2006.01)
*B41J 2/32* (2006.01)
(Continued)

(52) U.S. Cl.
CPC ..... *G07F 17/42* (2013.01); *B41J 2/32* (2013.01); *B41J 3/407* (2013.01); *B41J 3/4075* (2013.01);
(Continued)

(58) Field of Classification Search
CPC .... G07F 17/42; G07G 5/00; B41J 2/32; B41J 3/407; B41J 3/4075; B65H 20/02;
(Continued)

(56) References Cited

U.S. PATENT DOCUMENTS 6,109,472 A 8/2000 Gibier ..... B65C 11/00 221/33
9,079,438 B1 7/2015 Ishikawa et al. ..... B41J 11/70
(Continued)

FOREIGN PATENT DOCUMENTS

FR 2915926 5/2007
JP 2003146318 4/2002

OTHER PUBLICATIONS

European search report dated Oct. 16, 2018, from the European Patent Office in the parent international application EP18165625.7 (8 pages).

*Primary Examiner* — David H Banh
(74) *Attorney, Agent, or Firm* — Imperium Patent Works; Darien K. Wallace

(57) ABSTRACT

A presentation device for presenting a ticket from a printer includes first and second reels, a ticket holder and a housing component. In operation, the first reel contacts a first side of the ticket, and the second reel contacts a second side of the ticket opposite to where the first reel contacts the first side of the ticket. As the ticket advances from the presentation device, gravity pushes the ticket down onto the ticket holder, which is a reel. The first reel, the second reel and the ticket holder are secured in the housing component. The housing component is pivotable about a rotating axis and has a supporting notch that supports the second reel. The supporting notch has a first guide edge surface that faces away from the rotating axis, a second guide edge surface, and a trough between the first guide edge surface and the second guide edge surface.

15 Claims, 1 Drawing Sheet

(51) Int. Cl.

| | |
|---|---|
| ***B41J 3/407*** | (2006.01) |
| ***B65H 20/02*** | (2006.01) |
| ***B65H 27/00*** | (2006.01) |
| ***G07G 5/00*** | (2006.01) |
| ***B65H 29/12*** | (2006.01) |

(52) U.S. Cl.

CPC ..... *B65H 20/02* (2013.01); *B65H 27/00* (2013.01); *B65H 29/12* (2013.01); *G07G 5/00* (2013.01); *B65H 2404/143* (2013.01); *B65H 2404/144* (2013.01); *B65H 2404/147* (2013.01); *B65H 2404/1521* (2013.01); *B65H 2404/16* (2013.01); *B65H 2404/18* (2013.01); *B65H 2408/13* (2013.01); *B65H 2601/321* (2013.01); *B65H 2701/192* (2013.01); *B65H 2701/1936* (2013.01); *B65H 2801/75* (2013.01)

(58) Field of Classification Search

CPC .. B65H 27/00; B65H 29/12; B65H 2404/143; B65H 2404/144; B65H 2404/147; B65H 2404/1521; B65H 2404/16; B65H 2404/18; B65H 2408/13; B65H 2601/321; B65H 2701/192; B65H 2701/1936; B65H 2801/75

See application file for complete search history.

(56) References Cited

U.S. PATENT DOCUMENTS

| | | | | |
|---|---|---|---|---|
| 2006/0137549 | A1 | 6/2006 | Pallier | B41J 29/393 101/66 |
| 2006/0210344 | A1 | 9/2006 | Montagutelli | B41J 11/70 400/621 |
| 2011/0101602 | A1* | 5/2011 | Kohyama | B65H 29/58 271/265.01 |
| 2011/0140338 | A1* | 6/2011 | Supron | G07B 5/00 270/52.17 |
| 2011/0175283 | A1* | 7/2011 | Supron | G07B 5/00 271/279 |
| 2014/0119806 | A1 | 5/2014 | Ishikawa et al. | B26D 1/085 400/621 |
| 2015/0063890 | A1* | 3/2015 | Fujita | G03G 15/6552 399/395 |
| 2015/0202890 | A1 | 7/2015 | Ramming | B41J 3/4075 347/110 |
| 2017/0144850 | A1 | 5/2017 | Yanagida | B65H 5/062 |
| 2017/0320340 | A1 | 11/2017 | Oguchi et al. | B41J 15/005 |
| 2017/0364007 | A1* | 12/2017 | Kosaka | G03G 15/2028 |

* cited by examiner

PRESENTATION DEVICE FOR PRESENTING A TICKET FROM A PRINTER

CROSS REFERENCE TO RELATED APPLICATION

This application is based on and hereby claims the benefit under 35 U.S.C. § 119 from European Patent Application No. EP 18165625.7, filed on Apr. 4, 2018, in the European Patent Office. This application is a continuation-in-part of European Patent Application No. EP 18165625.7, the contents of which are incorporated herein by reference.

TECHNICAL FIELD

The invention relates to a presentation device for presenting a ticket, in particular from a printer, such as a thermal printer.

BACKGROUND

A printer can be fed with a material to be imprinted that is wound up on a wheel. These printers can be used for printing parking tickets or cash register receipts, for instance. For that purpose, along with a printing unit that prints the printing material, the printer has a cutting unit and a presentation device. The cutting unit separates a printed piece of the printing material from the remainder of the printing material, thereby making the printed piece into a ticket. The presentation device presents the ticket to a user and dispenses it to the user.

So that the user can be given the ticket, a position on the ticket after its separation until the user takes it, should be controlled by the presentation device. Conventionally, an interception region such as a compartment can be provided as the presentation device, into which region the separated ticket drops. However, that is intensive in terms of structural space, since for instance someone's hand, or a device, has to reach into the interception region. Moreover, drop direction can be controlled only very poorly, and if the tickets stick in the interception region, a ticket jam can develop.

Another known possibility is that the cutting unit does not separate the ticket from the printing material completely but only partially. As a result, the partly separated ticket still hangs from the printing material, and the user can tear off the ticket and take it by himself. However, this has the problem that when a ticket is torn off, the printing material that remains behind the cutting unit can be torn apart or torn off as well.

The object of the invention is therefore to create an improved presentation device for presenting tickets. A device is sought for presenting tickets to a user that are completely separated from the remaining printing material but yet that do not drop into a compartment.

SUMMARY

The invention relates to a presentation device for presenting a ticket that includes a first presentation reel, a second presentation reel that is located directly beside the first presentation reel, a ticket holder, a first housing component in which the first presentation reel and the ticket holder are secured and that is pivotable about a rotating axis and a second housing component. The first housing component has a supporting notch that supports the second presentation reel and that has a first guide edge surface facing away from the rotating axis, a second guide edge surface and a trough.

The first guide edge surface extends essentially along a second tangent plane that is perpendicular to a first plane in which the rotating axis is located. The second guide edge surface is inclined toward a second plane that is located in the rotational axis of the second presentation reel and is perpendicular to a third plane that extends through the second presentation reel and the ticket holder.

A presentation device for presenting a ticket from a printer includes a first presentation reel, a second presentation reel, a ticket holder and a first housing component. In operation of the device, the first presentation reel contacts a first side of the ticket, and the second presentation reel contacts a second side of the ticket opposite to where the first presentation reel contacts the first side of the ticket. As the ticket advances from the presentation device, gravity pushes the ticket down onto the ticket holder, which is a reel. The first presentation reel, the second presentation reel and the ticket holder are secured in the first housing component.

The first housing component is pivotable about a rotating axis and has a supporting notch that supports the second presentation reel. The supporting notch has a first guide edge surface that faces away from the rotating axis, a second guide edge surface, and a trough that extends from a first crossover edge of the first guide edge surface to a second crossover edge of the second guide edge surface. The first guide edge surface coincides with an outer surface of an imaginary cylinder that intersects the first crossover edge and whose rotational axis coincides with the rotating axis. The second guide edge surface, beginning at the second crossover edge, curves towards the first guide edge surface.

In one embodiment, the presentation device also includes one or more of a second housing component, a drive unit and a printer. The second housing component is secured non-pivotably relative to the rotating axis. The second housing component maintains the second presentation reel within a spacing above the trough. The second housing component can be located in a different printer region from the rotating axis of the first housing component. The drive unit drives at least one of the first presentation reel, the second presentation reel, or the reel of the ticket holder. The drive unit can include an electric motor or a mechanical coupling to the print cylinder.

Other embodiments and advantages are described in the detailed description below. This summary does not purport to define the invention. The invention is defined by the claims.

BRIEF DESCRIPTION OF THE DRAWING

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
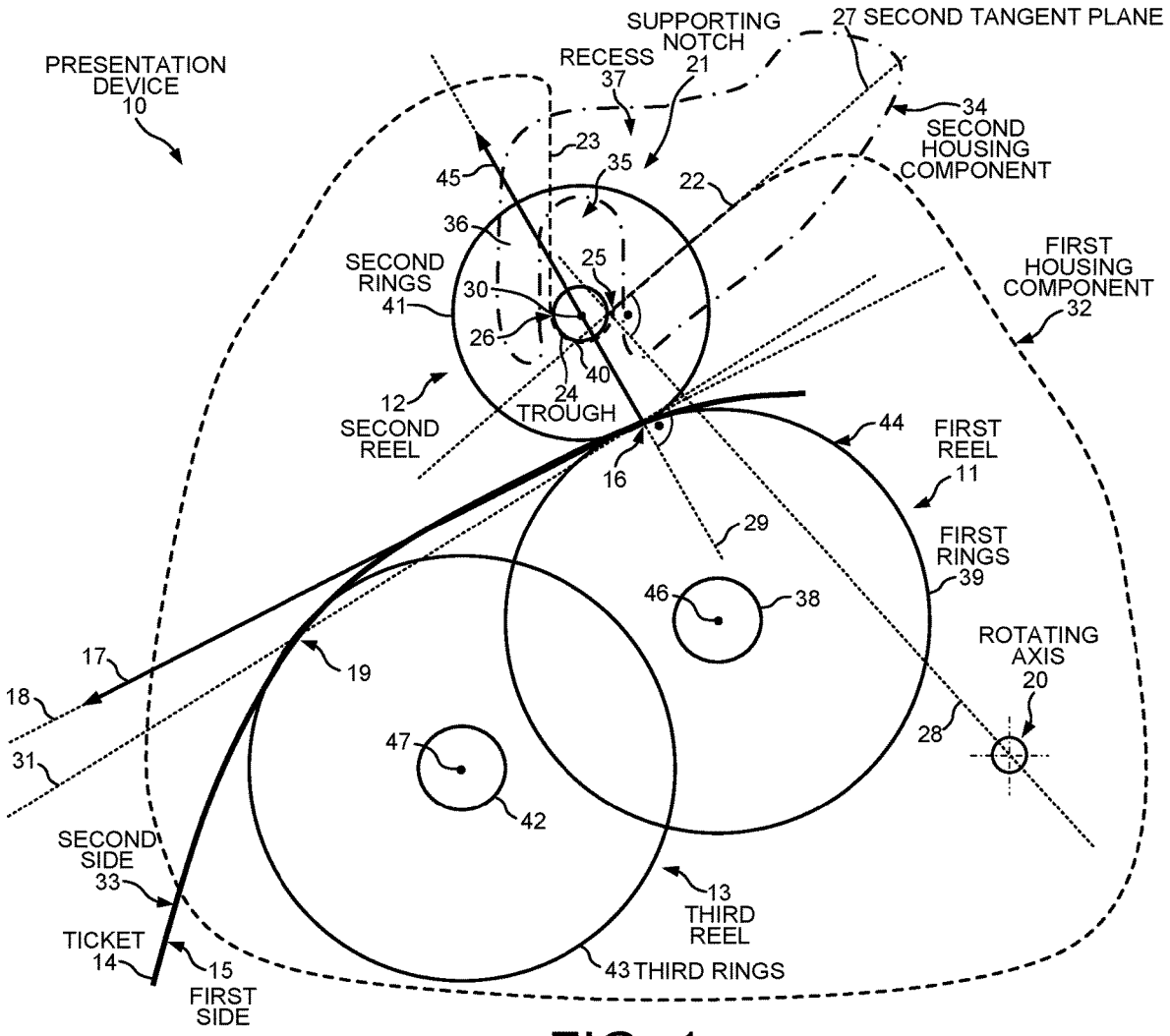
FIG. 1 shows a cross section through a presentation device for presenting a ticket.

FIG. 1 shows a presentation device 10 that includes has a first presentation reel 11, a second presentation reel 12 and a third presentation reel 13. The presentation device 10 is for presenting a ticket 14. In operation, the first presentation reel 11 is contacted by a first side 15 of the ticket 14. The second presentation reel 12 is located directly beside the first presentation reel 11 and is axially parallel to the first presentation reel 11. In operation, the first presentation reel 11 and the second presentation reel 12 simultaneously contact opposite sides of the ticket 14 at a contact point 16. The first presentation reel 11 and the second presentation reel 12 together define a ticket advancement direction 17 that runs along a first, common tangent plane 18 of the two presentation reels. A ticket holder 19 is spaced apart in the ticket advancement direction 17 from the first presentation reel 11 and additionally is offset from the first tangent plane 18 away from the second presentation reel 12.

The first presentation reel 11 and the ticket holder 19 are attached in a first housing component 32. The first housing component 32 is pivotable about a rotating axis 20 and has a supporting notch 21 in which the second presentation reel 12 is supported. The supporting notch 21 is composed of a first guide edge surface 22 facing away from the rotating axis 20, a second guide edge surface 23 that is oriented in V-shaped fashion to the first guide edge surface 22, and a trough 24 that extends from a first crossover edge 25 of the first guide edge surface 22 to a second crossover edge 26 of the second guide edge surface 23. The first crossover edge 25 is located at an end of the first guide edge surface 22, which extends essentially along a second tangent plane 27. The second tangent plane 27 is perpendicular to a first plane 28 that passes through both the first crossover edge 25 and the rotating axis 20. The second guide edge surface 23, beginning at the second crossover edge 26, inclines at an acute angle from a second plane 29 that passes through the rotational axis 30 of the second presentation reel 12 and is perpendicular to a third plane 31 that extends through the contact point 16 and the ticket holder 19.

The presentation device 10 is used together with a printer, which is not shown in FIG. 1. The printer can be a thermal printer. The presentation device 10 enables the user to take the ticket 14 that has been printed by the printer. The user can be either a human or a machine. The first presentation reel 11 and the second presentation reel 12 both contact the ticket 14 during operation of the presentation device 10 and thereby guide the ticket 14 through the presentation device 10 and issue it to the user. The ticket 14 is guided along the ticket advancement direction 17, which is defined by the first common tangent plane 18 of the first presentation reel 11 and the second presentation reel 12. The ticket advancement direction 17 is thus essentially the same for each type of ticket 14*s*, even if the tickets are of different lengths. This makes it easier for the user to take the ticket 14. Also as a result, a ticket 14 issuing position at which the ticket 14 is taken by the user can easily be specified for tickets that are of different lengths.

The ticket holder 19 serves to ensure that the ticket 14 is supported if it should warp or kink because of its weight. The greater the ticket's length, or the farther it is transported along the ticket advancement direction 17, the greater is the force that tries to lower the ticket 14 in the direction of gravity. The tickets can for instance be made from paper or paper-like material, and therefore the ticket 14 can be relatively flexible. The ticket 14 can become bent or drop in operation in the direction of gravity. Because the ticket holder 19 supports the ticket 14, the ticket 14 issuing position remains essentially the same even for different ticket lengths. This makes it easier for the user to take the ticket 14. In addition, because the ticket holder 19 is located away from the second presentation reel 12 and offset from the first tangent plane 18, it is ensured that the ticket holder 19 will not block a transportation path along the ticket advancement direction 17. Instead, the ticket holder 19 first contacts the ticket 14 when the ticket 14 has dropped somewhat. This enhances the operating safety of the presentation device 10 and reduces the risk of a ticket jam.

Because the first housing component 32, which secures both the first presentation reel 11 and the ticket holder 19, is pivotable about the rotating axis 20, the first housing component 32 can assume at least two positions. A first position is an operating position, and a second position is a maintenance position. In the operating position, the first housing component 32 is arranged for conveying the ticket 14, presenting it, and issuing it to the user. In the maintenance position, the first housing component 32 is pivoted open about the rotating axis 20, thereby providing access to the printer or the presentation device 10. The pivotablility of the first housing component 32 makes maintenance of the printer or the presentation device 10 easier. In the event that a printer with the presentation device 10 is in a continuous operation mode, a new amount of printing material must be replenished relatively often. For that purpose, the new printing material must be repositioned through all the relative components of the printer, including through the presentation device 10. Pivoting the first housing component 32 into the maintenance position allows easier access to the presentation device 10 and to the printer, thus making replacement of the printing material easier. Moreover, the printing material can be guided along the components faster, thus saving time. Once the printing material has been replaced, the first housing component 32 can be pivoted relatively easily back into the operating state, and the printer with the presentation device 10 can put back into operation. Additionally, the individual components of the presentation device 10, such as the first presentation reel 11 or the ticket holder 19 can be more easily replaced in the maintenance position.

Because the first housing component 32 has a supporting notch 21 that supports the second presentation reel 12, all of the components of the presentation device 10 that guide the ticket 14 are secured by means of the first housing component 32. This makes the handling of the presentation device 10 easier.

The first presentation reel 11 is rotatably supported in the first housing component 32. The second presentation reel 12 is rotatably supported in the supporting notch 21 of the first housing component 32. In addition, the second presentation reel 12 can move along the guide edge surfaces of the supporting notch 21 and between them.

The supporting notch 21 enables a translatory movement of the second presentation reel 12 along the guide edge surfaces and between them. In operation of the presentation device 10, any difference in thickness of the ticket 14 or warping of the ticket 14 that may occur can be compensated for by this movement of the second presentation reel 12. During the translatory movement of the second presentation reel 12, the first presentation reel 11 and the second presentation reel 12 stay in contact with the ticket 14. In operation, in order to maintain the contact of the second presentation reel 12 with the ticket 14, a prestressing mechanism with a spring, or some other mechanism can be used in addition to gravity.

Because the second guide edge surface 23 beginning at the second crossover edge 26 is inclined toward the second plane 29, any movement of the second presentation reel 12 up the second guide edge surface 23 is impeded. A ticket 14 that has dropped onto the ticket holder 19, and whose center of gravity in the advancement direction 17 is located downstream of the ticket holder 19, exerts a force on the second presentation reel 12 because of the stiffness of the ticket 14 and because the pivot point of the force is located at the ticket holder 19. This force on the second presentation reel 12 is directed towards the second guide edge surface 23, which impedes any movement of the reel 12 resulting from the force. Because the movement resulting from the force is impeded, the ticket 14 is retained by the presentation device 10 and will not slip away. Even if the ticket 14 is relatively long, it is retained by the presentation device 10 until the user takes it. The second guide edge surface 23 thus enables advantageous retention of the ticket 14, even with tickets of varying lengths.

The contact point 16 is the location on the second presentation reel 12 that is contacted by the second side 33 of the ticket 14 in operation. The contact point 16 is preferably a linear contact. In another embodiment, the contact point 16 is composed of a plurality of regions on the second presentation reel 12 that are contacted by the second side 33 of the ticket 14 in operation. The contact point 16 can also be reduced to a plurality of point-like regions that are contacted in operation by the second side 33 of the ticket 14. The distance between contact points on third plane 31 can thus be stretched by the linear contact with the ticket holder 19, or by the regions on the second presentation reel 12 that are contacted in operation by the second side 33 of the ticket 14 with the ticket holder 19, or by the point-like regions on the second presentation reel 12 that are contacted in operation by the second side 33 of the ticket 14 with the ticket holder 19.

The ticket holder 19 can be formed for instance by a strip, stop or other component that in operation is contacted by the ticket 14. The ticket holder 19 is the region on the strip, stop, or other component that is contacted in operation by the ticket 14. The region can for instance be two-dimensional, linear, or point-like.

Because the first guide edge surface 22 extends essentially along the second tangent plane 27, it is possible for the second presentation reel 12 to remain unpivoted, while the first housing component 32 along with the first presentation reel 11 and the ticket holder 19 is pivoted from the operating position into the maintenance position. The second presentation reel 12 can, during the pivoting, slide along the first guide edge surface 22 without essentially changes its position. The second presentation reel 12 can be held during the pivoting of the first housing component 32 by means of an additional component or by the user. The first guide edge surface 22 thus enables the advantageous pivoting of the first housing component 32 while simultaneously the second presentation reel 12 stays in the same position. This makes the maintenance and handling of the presentation device 10 easier.

The first guide edge surface 22, beginning at the first crossover edge 25, extends within a guide edge surface region that stretches from a plane that, relative to the second tangent plane 27, is rotated about the sectional axis between the second tangent plane 27 and the first plane 28 by more than 25 degrees, to another plane which relative to the second tangent plane 27 is rotated about the sectional axis between the second tangent plane 27 and the first plane 28 by minus 25 degrees. The shape of the first guide edge surface 22 can for instance be planar or curved or a combination of the two. The guide edge surface region can also be formed by two planes parallel to the second tangent plane 27, of which planes one is spaced apart from the second tangent plane 27 by plus ten millimeters and of which the other is spaced apart from the second tangent plane 27 by minus ten millimeters.

In summary, the supporting notch 21 thus has the effect that movement of the second presentation reel 12 is made possible to equalize the thickness of the ticket 14. However, additional movement of the second presentation reel 12 resulting from the force of the ticket rigidity is impeded. Thus, the maintenance of the presentation device 10 is made easier. Presenting the ticket 14, issuing the ticket 14, and maintaining the presentation device 10 is considerably facilitated by the combination of the pivotable first housing component 32, the supporting notch 21, and the locations of the first presentation reel 11, the second presentation reel 12, and the ticket holder 19. The presentation device 10 thus considerably improves the presentation and issuance of the ticket 14.

The presentation device 10 has a second housing component 34 that is secured nonpivotably relative to the rotating axis 20. The second housing component 34 guides the second presentation reel 12 with a spacing 35 that extends from the second housing component 34 to the second presentation reel 12. The spacing 35 can vary along the second housing component 34. The second housing component 34 can for instance be located in a different printer region from the rotating axis 20 of the first housing component 32. As a result, the pivoting of the first housing component 32 is not impaired by the second housing component 34. The second housing component 34 can have a protrusion 36 that guides the second presentation reel 12 with the spacing 35 that extends from the protrusion 36 to the second presentation reel 12. The second housing component 34 can also have a recess 37 in which the second presentation reel 12 is located. The spacing 35 between the second housing component 34 and the second presentation reel 12 should be selected such that a desired movement, which is made possible by the first guide edge surface 22 and the second guide edge surface 23, of the second presentation reel 12 is unimpaired, yet at the same time the second presentation reel 12, upon pivoting of the first housing component 32, is retained and thus does not swivel along with that housing component. The second housing component 34 can thus make the handling and maintenance of the presentation device 10 easier.

The first side 15 of the ticket 14 that is contacted in operation of the presentation device 10 has an adhesive layer. The adhesive layer allows the ticket 14 that is taken from the presentation device 10 to be directly glued onto a device by the user. For instance, the ticket 14 with the adhesive layer can be immediately glued onto a product that is to be labeled. When the ticket 14 and the printing material have the adhesive layer, guiding the printing material or the ticket 14 through the printer and through the presentation device 10 in operation is more complicated because the adhesive layer contacts components and as a result the printing material or the ticket 14 can stick to the components. The printing material that has the adhesive layer can be a so-called "linerless printing material" or "linerless paper".

Because the ticket 14 or the printing material have the adhesive layer on the first side 15, in operation the adhesive contacts the first presentation reel 11 and the ticket holder 19 of the presentation device 10. It is also conceivable that the ticket 14 has the adhesive layer on the second side 33.

The ticket holder 19 preferably has a third presentation reel 13 that in operation contacts the ticket 14. Thus, in some embodiments, the ticket holder 19 is formed by the third presentation reel 13. The third presentation reel 13 can be designed similarly to the second presentation reel 12 or to the first presentation reel 11. The third presentation reel 13 can be supported rotatably in the first housing component 32. Because the ticket holder 19 has a third presentation reel 13, in operation the ticket 14 is not scraped as it moves along the ticket holder 19. Instead, the ticket 14 can move along with the rotating third presentation reel 13. The advancement direction 17 and issuance of the ticket 14 are therefore more uniform and fluid. This prevents a jam and improves the presentation and issuance of the ticket 14. When the ticket 14 has the adhesive layer on the first side 15, the adhesive layer contacts the third presentation reel 13 during operation of the presentation device 10. A ticket 14 with an adhesive layer that scrapes on the ticket holder 19 in operation would easily lead to sticking or unwanted accumulations of adhesive. This can be reduced or avoided by means of the third presentation reel 13. The operation of the presentation device 10 is thus improved even with tickets that have an adhesive layer.

In one embodiment, the presentation device 10 has no separate drive unit for rotationally driving the first presentation reel 11 and/or the second presentation reel 12 and/or the third presentation reel 13. The advancement movement of the ticket 14 or of the printing material in operation can be achieved using other components of the printer, such as a print cylinder.

Figure 2:
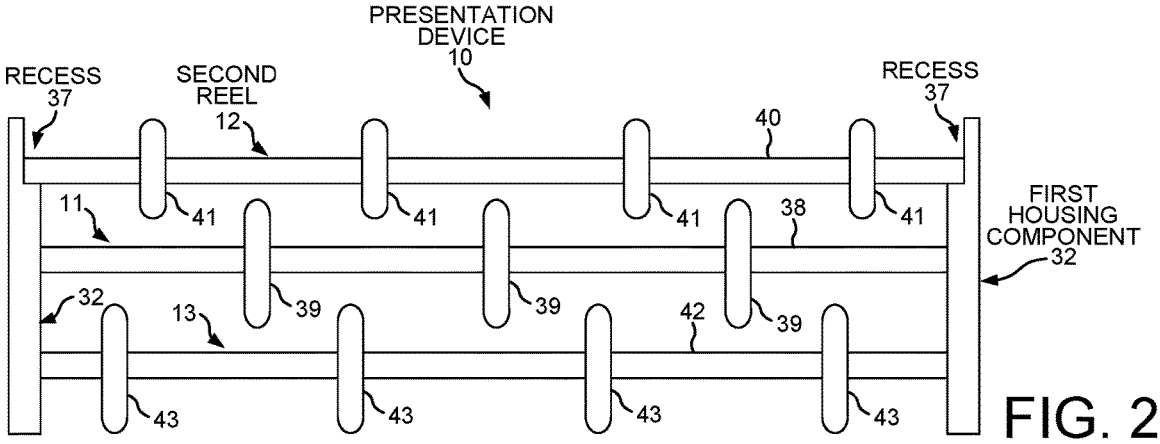
FIG. 2 shows a front view of the presentation device of FIG. 1.

FIG. 2 shows that the first presentation reel 11 has a first shaft 38, on which a plurality of first rings 39 are arranged spaced apart from one another. The second presentation reel 12 has a second shaft 40 on which a plurality of second rings 41 are located spaced apart from one another. And the third presentation reel 13 has a third shaft 42 on which a plurality of third rings 43 are arranged spaced apart from one another.

In operation, the rings 39, 41, 43 contact the ticket 14. The shafts 38, 40, 42 are rotatably secured in the first housing component 32, and the respective rings 39, 41, 43 are fixedly connected to the respective shafts. However, the rings can also be rotatably attached to the respective shafts. The spacing between the various rings on the same shaft can also vary.

In operation, the contact between the ticket 14 and the presentation reels could potentially extend over the entire length of each presentation reel. This large-area contact, particularly with tickets that have an adhesive layer, can lead to unwanted sticking of the ticket to the reel. Reducing this large-area contact can counteract this problem. Because the rings 39, 41, 43 are arranged on the respective shafts 38, 40, 42 spaced apart from one another, and only the rings contact the ticket 14 in operation, the contact of the ticket with the various presentation reels is interrupted and thereby reduced. The presentation and issuance of the ticket 14 by the presentation device 10 can thereby be facilitated and improved.

At least one of the rings, in the cross-sectional plane in which the ring's rotational axis is located, has an outwardly arched cross section. Because at least one of the rings has the outwardly arched cross section, a point contact is established during operation between the ticket 14 and the ring. As a result, the overall cross-sectional contact area between the ticket and the ring is reduced to a point contact. The presentation and issuance of the ticket 14 by the presentation device 10 is thereby further facilitated and improved, especially if the ticket 14 has the adhesive layer.

The first rings 39 on the first shaft 38 are offset from the second rings 41 on the second shaft 40 such that the rings can overlap one another from the side perspective of FIG. 1. Similarly, the first rings 39 on the first shaft 38 are offset from the third rings 43 on the third shaft 42. Moreover, the second rings 41 on the second shaft 40 are offset from the third rings 43 on the third shaft 42. The offset locations of the rings allow for overlapping in the plane orthogonal to the shaft axes and reduce the structural space needed to accommodate the individual presentation reels in the first housing component 32. The presentation device 10 can as a result be more compact. Furthermore, the spacing between the rings can be adapted such that in operation the advancement motion of the ticket 14 is more fluid, which improves the presentation and issuance of the ticket 14. Moreover, because the spacing of the second rings 41 is offset relative to the spacing of the third rings 43, the ticket 14 is prevented from rolling away and separating from the first rings 39 because the third rings 43 represent an additional structural barrier. This improves the operating safety.

At least one of the first rings 39, second rings 41 and/or third rings 43 has an anti-adhesive surface 44 that in operation contacts the ticket 14. All of the rings could have the anti-adhesive surface 44. The anti-adhesive surface 44 reduces the adhesion of the rings to the ticket 14. As a result, an advantageous presentation and issuance can be achieved during continuous operation, especially for a ticket 14 that has an adhesive layer. Furthermore, cleaning a coated anti-adhesive surface is easier than cleaning an uncoated surface. This facilitates maintenance of the presentation device 10. At least one of the presentation reels could also have the anti-adhesive surface 44.

In one embodiment, the anti-adhesive surface 44 includes polytetrafluoroethylene (PTFE), chemically (C2F4)n, which is also known by the trade name "Teflon". The rings that have an anti-adhesive surface made of polytetrafluoroethylene (PTFE) reduce the adhesive effect of the various rings with the ticket 14.

In one embodiment, the first guide edge surface 22 of the supporting notch 21 is not planar but rather coincides at least partially with the outer surface of an imaginary cylinder that intersects the first crossover edge 25 and whose rotational axis coincides with the rotating axis 20. The shape of the first guide edge surface 22 is thus at least partially that of the imaginary cylinder whose rotational axis coincides with the rotating axis 20. If the first housing component 32 is rotated about the rotating axis 20, the absolute position of the second presentation reel 12 can remain unchanged because the second presentation reel 12 can move along the first guide edge surface 22, whose shape coincides with that of the imaginary cylinder. As a result, the pivoting of the first housing component 32 from the operating position to the maintenance position is especially simple, and the handling and maintenance of the presentation device 10 are simplified.

In one embodiment, the second guide edge surface 23, beginning at the second crossover edge 26, has a partially concave curved shape relative to that of the first guide edge surface 22. Thus, the second guide edge surface 23, beginning at the second crossover edge 26, curves towards the first guide edge surface 22. The curvature can increase with increasing distance from the second crossover edge 26. In operation, the curved shape has the effect that an increasing deflection of the second presentation reel 12 resulting from a force 45 directed away from the contact point 16 increases the impedance against that force. The greater the deflection of the second presentation reel 12, the more that any additional movement of the second presentation reel 12 is impeded due to the curved shape of the second guide edge surface 23. The impedance is applied as a function of the length of the ticket 14 and of the resulting force 45. As a result, tickets that are especially long can be advantageously presented, held and issued in operation.

The first housing component 32 has a housing component recess 37 defined by the first guide edge surface 22, the trough 24, and the second guide edge surface 23. Because of the housing component recess 37, the first housing component 32 is open in a region that extends from the first guide edge surface 22 to the second guide edge surface 23. As a result, the second presentation reel 12 can easily be removed from the first housing component 32 or inserted into the supporting notch 21 of the first housing component 32. Maintenance and handling of the presentation device 10 are thereby made easier.

The presentation device 10 includes a drive unit that is arranged for rotationally driving the first presentation reel 11, the second presentation reel 12 and/or the third presentation reel 13. The presentation reels can for instance be rotationally driven using an electric drive. The presentation reels could also be rotationally driven using a mechanical coupling with the print cylinder. The drive of each individual presentation reel can be derived from the drive of the print cylinder, so that an optimal advancement of the ticket 14 is made possible. The presentation reels can be braked or stopped by controlling the drive. As a result, it is possible to counteract unwanted slipping or uncontrolled rolling away of the ticket 14 during operation.

The printer to which the presentation device 10 is associated can be a thermal printer. The presentation device 10 can also be a retrofitting solution for existing printers.

FIG. 1 shows that the presentation device 10 for presenting a ticket 14 includes a first presentation reel 11, a second presentation reel 12, a third presentation reel 13, a first housing component 32, and a second housing component 34. The third presentation reel 13 serves as a ticket holder 19 in one embodiment. The first presentation reel 11 is oriented axially parallel the second presentation reel 12 and is located directly adjacent to the second presentation reel 12. The ticket 14 has a first side 15 and a second side 33. In operation of the presentation device 10, the first presentation reel 11, the second presentation reel 12, and the third presentation reel 13 all contact the ticket 14. The first side 15 of the ticket 14 is contacted by the first presentation reel 11 and the third presentation reel 13, and the second side 33 of the ticket 14 is contacted by the second presentation reel 12. The first presentation reel 11 and the second presentation reel 12 simultaneously contact opposite sides of the ticket 14 at the same location. The rotation of the first presentation reel 11 and the second presentation reel 12 cause the ticket 14 to move in the ticket advancement direction 17. The ticket advancement direction 17 runs along a first tangent plane 18, which is the common tangent plane of both the first presentation reel 11 and of the second presentation reel 12. The ticket advancement direction 17 extends from right to left in FIG. 1, beginning at a cutting unit of a printer (not shown) through the presentation device 10 to an issuing position at the left at which a user can take the ticket 14. The third presentation reel 13 is spaced apart in the ticket advancement direction 17 from the first presentation reel 11 and is additionally offset under the first tangent plane 18 and away from the second presentation reel 12. Because the circumference of the third presentation reel 13 is offset below the first tangent plane 18, the ticket 14 contacts the third presentation reel 13 only after the ticket 14 has dropped due to the force of gravity acting on it.

The first presentation reel 11 rotates about a first rotational axis 46; the second presentation reel 12 rotates about a second rotational axis 30; and the third presentation reel 13 rotates about a third rotational axis 47. The first presentation reel 11 and the third presentation reel 13 are supported rotatably about their rotational axes 46, 47 by the first housing component 32.

The first housing component 32 is pivotable about a rotating axis 20. The first housing component 32 includes a supporting notch 21 that supports the second presentation reel 12. The supporting notch 21 has a trough 24 remote from the rotating axis 20, a first guide edge surface 22 and a second guide edge surface 23 that is arranged in V-shaped fashion relative to the first guide edge surface 22. The trough 24 is at the bottom of the "V" shape. The trough 24 extends from a first crossover edge 25 of the first guide edge surface 22 of the trough 24 as far as a second crossover edge 26 of the second guide edge surface 23 of the trough 24. The first guide edge surface 22 and the second guide edge surface 23 thus jointly form the "V" shape in the cross section that is orthogonal to the first rotational axis 46. The second presentation reel 12 is supported in the supporting notch 21 such that it can move both rotationally and translatorally. In its resting position, the second presentation reel 12 is supported in the trough 24. The trough 24 is formed by a partial cylindrical groove between the surfaces of the first guide edge surface 22 and the second guide edge surface 23. Alternatively, the cross section of the trough 24 is not a portion of a circle but rather a portion of some other geometric shape, such as a rectangular parallelepiped or an ellipse. In operation of the presentation device 10, the second presentation reel 12 can move along the first guide edge surface 22 and the second guide edge surface 23 and in the region between them.

The first guide edge surface 22 extends away from the first crossover edge 25 along a second tangent plane 27 that is perpendicular to a first plane 28 through which the rotating axis 20 and the first crossover edge 25 pass. If the first housing component 32 is pivoted about the rotating axis 20 counter-clockwise in FIG. 1, then because of the orientation of the first guide edge surface 22, the second presentation reel 12 can maintain its absolute position (its prior resting position) by traveling along the first guide edge surface 22 if the second presentation reel 12 is retained at that absolute position by a user or by the second housing component 34.

The second guide edge surface 23 is inclined at an acute angle between the second crossover edge 26 and a second plane 29 that passes through the second rotational axis 30 and is perpendicular to a third plane 31. The third plane 31 passes through both the contact point 19 at which the ticket 14 contacts the third presentation reel 13 and the contact point 16 at which the ticket 14 contacts both the first presentation reel 11 and the second presentation reel 12. The third plane 31 deviates from the first tangent plane 18 in that the contact point 19 is offset below the first tangent plane 18. A force 45 acting on the second presentation reel 12 in a direction away from the contact point 16 would push the reel 12 towards the second guide edge surface 23, which would impede any movement of the reel 12 due to the inclination of the second guide edge surface 23.

In one embodiment, the first presentation reel 11 includes a first shaft 38 to which the first rings 39 attached. The first rings 39 are spaced apart from one another on the first shaft 38. The second presentation reel 12 includes a second shaft 40 to which the second rings 41 are attached. The second rings 41 are also spaced apart from one another on the second shaft 40. The third presentation reel 13 includes a third shaft 42 to which third rings 43 are attached, which are spaced apart from one another. In operation of the presentation device 10, only the rings 39, 41, 43 contact the ticket 14. As a result, contact between the various presentation reels 11, 12, 13 and the ticket 14 is reduced.

The second housing component 34 is secured nonpivotably about the rotating axis 20. Furthermore, the second housing component 34 has a recess into which the second shaft 40 of the second presentation reel 12 passes. On the second housing component 34, the recess forms a protrusion 36, which includes the second shaft 40, in part with a spacing 35 that extends from the protrusion 36 as far as the second shaft 40. When the first housing component 32 is pivoted clockwise about the rotating axis 20, the spacing 35 is reduced to zero. As a result, the protrusion 36 contacts the second shaft 40, and the second presentation reel 12 is retained such that it can no longer pivot about the rotating axis 20.

As can be seen particularly from FIG. 2, the rings 39, 41, 43, in a plane in which their respective rotational axis is located, have an outwardly arched cross section. The contact of the ticket 14 with the respective presentation reels 11, 12, 13 is as a result reduced, for each of the rings 39, 41, 43, to a point contact.

FIG. 2 shows that the first rings 39 on first shaft 38 are offset relative to the second rings 41 on second shaft 40. Furthermore, the first rings 39 on first shaft 38 are offset relative to the third rings 43 on third shaft 42. The second rings 41 on second shaft 40 are also offset relative to the third rings 43 on third shaft 42. As a result of the rings being offset from one another, the first presentation reel 11 and the third presentation reel 13 can overlap from the side perspective of FIG. 1 such that the reels are arranged in a space-saving manner side-by-side with one inside the other. The rings 39, 41, 43 have an anti-adhesive surface 44, which when the presentation device 10 is in operation contacts the ticket 14. The anti-adhesive surface 44 can include or even be made of Teflon and/or silicon.

From the drawings, it can furthermore be seen that the first housing component 32 has a housing component recess 37. The housing component recess 37 is defined by the first guide edge surface 22, the trough 24, and the second guide edge surface 23. The housing component recess 37 forms an opening of the first housing component 32 that allows the second presentation reel 12 to be easily placed in the supporting notch 21.

REFERENCE NUMERALS

10 presentation device
11 first presentation reel
12 second presentation reel
13 third presentation reel
14 ticket
15 first side
16 contact point
17 ticket advancement direction
18 first tangent plane
19 ticket holder
20 rotating axis
21 supporting notch
22 first guide edge surface
23 second guide edge surface
24 trough
25 first crossover edge
26 second crossover edge
27 second tangent plane
28 first plane
29 second plane
30 second rotational axis
31 third plane
32 first housing component
33 second side
34 second housing component
35 spacing
36 protrusion
37 housing component recess
38 first shaft
39 first rings
40 second shaft
41 second rings
42 third shaft
43 third rings
44 anti-adhesive surface
45 force
46 first rotational axis
47 third rotational axis Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

What is claimed is:

1. An device comprising:

a first presentation reel that in operation of the device contacts a first side of a ticket;

a second presentation reel that is disposed adjacent to the first presentation reel and axially parallel to the first presentation reel, wherein in operation of the device the second presentation reel contacts a second side of the ticket at a contact point opposite to where the first presentation reel contacts the first side of the ticket, wherein in operation of the device the ticket moves in a ticket advancement direction that runs along a common tangent plane of the first presentation reel and the second presentation reel;

a ticket holder that is spaced apart from the first presentation reel in the ticket advancement direction and that is disposed below the common tangent plane; and a first housing component in which the first presentation reel and the ticket holder are secured, wherein the first housing component is pivotable about a rotating axis, wherein the first housing component has a supporting notch that supports the second presentation reel, wherein the supporting notch has a first guide edge surface that faces away from the rotating axis, a second guide edge surface that is arranged in V-shaped fashion relative to the first guide edge surface, and a trough that extends from a first crossover edge of the first guide edge surface to a second crossover edge of the second guide edge surface, and wherein the first guide edge surface is perpendicular to a first plane that passes through the first crossover edge and the rotating axis.

2. The device of claim 1, wherein the device includes a second housing component that is secured nonpivotably relative to the rotating axis and that guides the second presentation reel.

3. The device of claim 1, wherein the ticket holder includes a third presentation reel that contacts the ticket in operation of the device.

4. The device of claim 1, wherein the first presentation reel has a first shaft on which a plurality of first rings are arranged spaced apart from one another, wherein the second presentation reel has a second shaft on which a plurality of second rings are arranged spaced apart from one another, wherein the third presentation reel has a third shaft on which a plurality of third rings are arranged spaced apart from one another, and wherein in operation of the device the first rings, the second rings and the third rings all contact the ticket.

5. The device of claim 1, wherein the first rings are arranged along a first shaft, and the second rings are arranged along a second shaft, and wherein the first rings are offset from the second rings in a plane that passes axially through both the first shaft and the second shaft.

6. The device of claim 5, wherein at least one of the first rings has an outwardly arched cross section in a plane that passes axially through both the first shaft and the second shaft.

7. The device of claim 1, wherein at least one of the first rings, second rings, or third rings has an anti-adhesive surface that contacts the ticket in operation of the device.

8. The device of claim 7, wherein the anti-adhesive surface includes polytetrafluoroethylene (PTFE).

9. The device of claim 1, wherein an adhesive layer is disposed on the first side of the ticket.

10. The device of claim 1, wherein the first guide edge surface of the supporting notch is not planar but rather coincides at least partially with an outer surface of an imaginary cylinder that intersects the first crossover edge and whose rotational axis coincides with the rotating axis.

11. The device of claim 1, wherein the second guide edge surface, beginning at the second crossover edge, curves towards the first guide edge surface.

12. The device of claim 1, wherein the first housing component has a housing component recess defined by the first guide edge surface, the trough, and the second guide edge surface, and wherein the second presentation reel fits into the housing component recess.

13. The device of claim 1, further comprising:

a drive unit that drives at least one of the first presentation reel, the second presentation reel, or the third presentation reel.

14. The device of claim 1, further comprising:

a printer that prints the ticket.

15. The device of claim 1, wherein the printer is a thermal printer.

* * * * *